US011066893B2

(12) United States Patent
Thomeer et al.

(10) Patent No.: US 11,066,893 B2
(45) Date of Patent: Jul. 20, 2021

(54) DEVICES AND RELATED METHODS FOR HYDRAULIC FRACTURING

(71) Applicant: BJ Energy Solutions, LLC, Houston, TX (US)

(72) Inventors: Hubertus V. Thomeer, Houston, TX (US); Sean A. Osborne, Meadows Place, TX (US); Erik M. Howard, Seguin, TX (US)

(73) Assignee: BJ Energy Solutions, LLC, Houston, TX (US)

( * ) Notice: Subject to any disclaimer, the term of this patent is extended or adjusted under 35 U.S.C. 154(b) by 0 days.

(21) Appl. No.: 16/227,987

(22) Filed: Dec. 20, 2018

(65) Prior Publication Data

US 2020/0199961 A1 Jun. 25, 2020

(51) Int. Cl.
*E21B 33/068* (2006.01)
*E21B 43/26* (2006.01)
*E21B 17/02* (2006.01)

(52) U.S. Cl.
CPC ..... *E21B 33/068* (2013.01); *E21B 17/02* (2013.01); *E21B 43/26* (2013.01)

(58) Field of Classification Search
CPC ..... E21B 33/068; E21B 17/02; E21B 43/26
See application file for complete search history.

(56) References Cited

U.S. PATENT DOCUMENTS 3,233,907 A * 2/1966 Stanton ..... F16L 27/1275 277/616
3,723,702 A * 3/1973 Clay ..... B23K 9/0288 219/60.2
4,364,587 A * 12/1982 Samford ..... E21B 17/02 166/377
4,411,317 A * 10/1983 Gieswein ..... E21B 43/013 166/347
6,902,199 B2 * 6/2005 Colyer ..... E21B 33/038 285/29
6,913,294 B2 * 7/2005 Treverton ..... F16L 21/06 285/334.5
6,938,690 B2 * 9/2005 Surjaatmadja ..... C09K 8/74 166/242.2
8,839,867 B2 * 9/2014 Conrad ..... E21B 43/26 166/308.1
8,905,056 B2 * 12/2014 Kendrick ..... F04D 29/426 137/15.01
9,517,713 B2 * 12/2016 Honigsberg ..... B60P 3/07
(Continued)

OTHER PUBLICATIONS

Halliburton Brochure, High Pressure Pumping Technology, "Q10 Pumping Unit", Apr. 2012, 2 pages.
(Continued)

*Primary Examiner* — Aaron L Lembo
(74) *Attorney, Agent, or Firm* — Womble Bond Dickinson (US) LLP

(57) ABSTRACT

A system for delivering a fracturing fluid at a well site includes an input and a manifold assembly. The manifold assembly is connected receives a fluid mixture from the input and includes a plurality of manifold modules. Each manifold module includes a plurality of flow line segments, and at least one connector. The connector has a telescopically extendable end face connecting at least one flow line segment of the plurality of flow line segments to an adjacent connector assembly.

20 Claims, 12 Drawing Sheets

(56) References Cited

U.S. PATENT DOCUMENTS

| | | | | |
|---|---|---|---|---|
| 9,568,138 | B2 | 2/2017 | Arizpe et al. | |
| 9,915,132 | B2 | 3/2018 | Conrad | |
| 10,302,079 | B2 * | 5/2019 | Kendrick | F04B 1/12 |
| 10,385,662 | B2 * | 8/2019 | Conrad | E21B 34/14 |
| 10,466,719 | B2 * | 11/2019 | Kibler | B25J 13/006 |
| 10,494,898 | B2 * | 12/2019 | Kajaria | E21B 17/02 |
| 10,526,862 | B2 * | 1/2020 | Witkowski | E21B 43/26 |
| 2010/0263872 | A1 | 10/2010 | Bull et al. | |
| 2011/0272158 | A1 | 11/2011 | Neal | |
| 2012/0060929 | A1 | 3/2012 | Kendrick | |
| 2012/0085541 | A1 * | 4/2012 | Love | G06Q 30/0611 166/308.1 |
| 2013/0284455 | A1 | 10/2013 | Kajaria et al. | |
| 2014/0374122 | A1 | 12/2014 | Fanguy et al. | |
| 2015/0204173 | A1 | 7/2015 | Shampine et al. | |
| 2017/0122060 | A1 | 5/2017 | Dille et al. | |
| 2017/0241231 | A1 * | 8/2017 | Benzie | E21B 33/128 |
| 2017/0241711 | A1 * | 8/2017 | Seehausen, Jr. | F26B 21/006 |
| 2018/0073664 | A1 * | 3/2018 | Readman | F16L 27/1275 |
| 2018/0187537 | A1 | 7/2018 | Hill et al. | |
| 2018/0187662 | A1 | 7/2018 | Hill et al. | |
| 2018/0223621 | A1 * | 8/2018 | McGuire | E21B 33/04 |
| 2018/0223640 | A1 * | 8/2018 | Keihany | F16L 41/03 |
| 2018/0224044 | A1 | 8/2018 | Penney et al. | |
| 2018/0283151 | A1 * | 10/2018 | Cook | E21B 43/26 |
| 2018/0283618 | A1 | 10/2018 | Cook | |
| 2018/0284816 | A1 | 10/2018 | Cook et al. | |
| 2018/0284817 | A1 | 10/2018 | Cook et al. | |
| 2019/0128454 | A1 * | 5/2019 | Chirko | F16L 27/12 |

OTHER PUBLICATIONS

Weir Oil & Gas, "SPM Simplified Frac Iron", 2018, 1 page.

S.M.P. Flow Control, Inc., "SPM Flow Control Products Catalog" Feb. 2020. 1-64.

VorTeq Brochure, "Truly Disruptive Technology for Hydraulic Fracturing", date unknown, 2 pages.

Forum Energy Technologies, Inc., Manifold Trailers, www.f-e-t.com/stimulation/manifold-trailers, May 2020, 1-2.

Jacobs, Trent; "Schlumberger: New Automated Hydraulic Fracturing Tech Trims Time and Workforce Requirements", https://pubs.spe.org/en/jpt/jpt-article-detail/art=2892, JPT Digital Editor, vol. 69:5, Apr. 7, 2017, 1-2.

* cited by examiner

DEVICES AND RELATED METHODS FOR HYDRAULIC FRACTURING

FIELD OF THE DISCLOSURE

This disclosure pertains generally to systems and methods for hydraulic fracturing.

BACKGROUND OF THE DISCLOSURE

The production of fluids from subterranean formations sometimes requires hydraulically fracturing a formation to enhance the flow of resident fluids from the formation into the wellbore. Hydraulic fracturing is typically employed to stimulate wells that produce from low permeability formations. During hydraulic fracturing, a fracturing fluid is injected into the wellbore at high pressures to create fractures in the rock formation surrounding the bore. The fractures radiate outwardly from the wellbore, typically from a few to hundreds of meters, and extend the surface area from which oil or gas drains into the well. The present disclosure provides systems and related methods for more efficiently performing hydraulic fracturing operations.

SUMMARY OF THE DISCLOSURE

In aspects, the present disclosure provides a system for delivering a fracturing fluid at a well site. The system may include an input and a manifold assembly. The manifold assembly is connected to and receives a fluid mixture from the input. The manifold assembly includes a plurality of manifold modules. Each manifold module includes a plurality of flow line segments, and at least one connector. The connector has a telescopically extendable end face connecting at least one flow line segment of the plurality of flow line segments to an adjacent connector assembly.

In further aspects, the present disclosure provides a system for delivering a fracturing fluid at a well site that includes at least one mixer, a low pressure manifold, a manifold assembly, and at least one pressure increaser. The mixer forms a mixture from at least a granular material received from at least one granular material source, and a liquid carrier received from at least one liquid carrier source. The low pressure manifold receives the mixture from the mixer. The manifold assembly is connected to and receives the mixture from the low pressure manifold. The manifold assembly includes a plurality of manifold modules. Each manifold module includes a plurality of flow line segments, and at least one connector. The connector has a telescopically extendable end face connecting at least one flow line segment of the plurality of flow line segments to an adjacent connector assembly. The pressure increaser receives a portion of the mixture from the manifold assembly and pumps the mixture portion at a higher pressure into the manifold assembly.

In still further aspects, the present disclosure provides a method for delivering a fracturing fluid at a well site. The method may include the steps of positioning a plurality of manifold modules at target locations at the well site. Each manifold module includes a plurality of flow line segments, and at least one connector having a telescopically extendable end face connecting at least one flow line segment of the plurality of flow line segments to an adjacent connector assembly. The method includes the further steps of forming a manifold assembly by extending the telescopically extendable end face of each at least one connector to connect each at least one flow line segment with the associated adjacent connector assembly; connecting the manifold assembly to a low pressure manifold; forming a mixture using at least one mixer configured to form a mixture, the mixture including at least a granular material and a liquid carrier; conveying the mixture to the manifold assembly using the low pressure manifold; conveying the mixture to at least one pressure increaser; increasing a pressure of the mixture using the at least one pressure increaser; and conveying the pressurized mixture from the at least one pressure increaser to a well head using the manifold assembly.

Examples of certain features of the disclosure have been summarized rather broadly in order that the detailed description thereof that follows may be better understood and in order that the contributions they represent to the art may be appreciated.

BRIEF DESCRIPTION OF THE DRAWINGS

For a detailed understanding of the present disclosure, reference should be made to the following detailed description of the embodiments, taken in conjunction with the accompanying drawings, in which like elements have been given like numerals, wherein.

DETAILED DESCRIPTION

Figure 1:
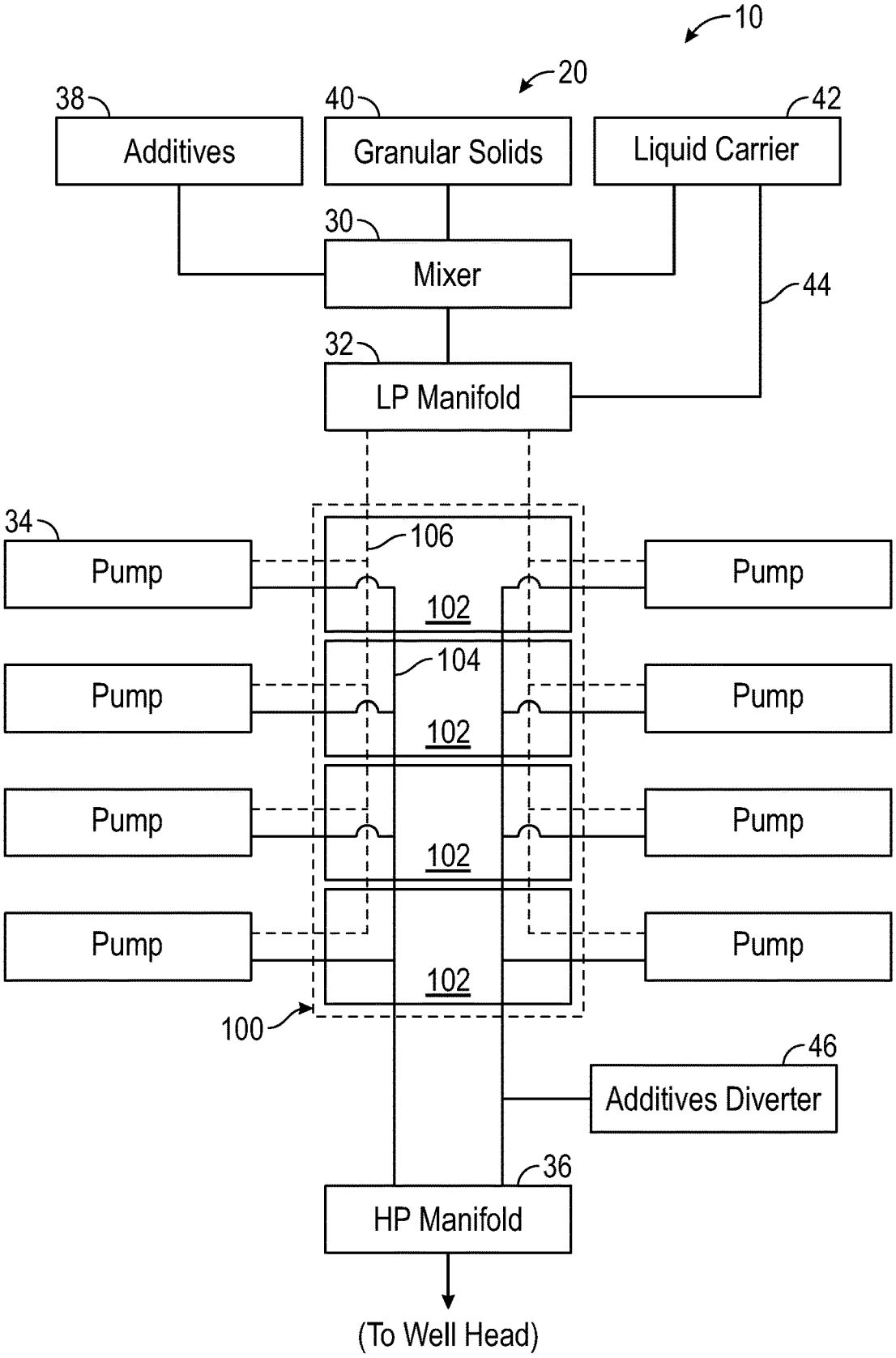
FIG. 1 schematically illustrates a well site having a hydraulic fracturing system according to one embodiment of the present disclosure.

Referring to FIG. 1, there is shown a well site 10 at which is positioned a hydraulic fracturing system 20 configured to hydraulically fracture a formation using one or more fracturing fluids. The system 20 pressurizes and conveys the fracturing fluid to a well head (not shown). Thereafter, a work string (not shown) directs the pressurized fluid to one or more subsurface zones selected for fracturing. As discussed below, hydraulic fracturing systems in accordance with the teachings of the present disclosure can enhance efficiency and reduce costs during the transport, deployment, assembly, operation, maintenance, and re-deployment of such systems.

In one non-limiting arrangement, the system 20 may include a mixer 30, an input 32, one or more pumps 34, and an output 36. For illustration, the input 32 is a low pressure manifold input 32 and the output 36 is a high pressure manifold output 36. The mixer 30 may receive one or more additives from an additive source 38, granular solids from a granular solids source 40, and a liquid carrier from a liquid carrier source 42. The mixer 30 mixes the received material and produces a fluid mixture that is conveyed to the low pressure manifold input 32. Optionally, the low pressure manifold input 32 may separately receive other materials, such the liquid carrier from the liquid carrier source 42 via one or more separate lines 44. In other variants, one or more additive diverters 46 may be used to add one or more additives into the fluid mixture downstream of the low pressure manifold 32.

The system 20 may include a manifold assembly 100 that receives the fluid mixture from the low-pressure manifold input 32 and distributes the fluid mixture to one or more pumps 34. The pumps 34 may be any device configured to increase a pressure of the fluid mixture, or generally "pressure increaser." That is, the pumps 34 create a positive pressure differential between the fluids exiting the low pressure manifold input 32 and the fluids received at the high pressure manifold output 36. Thereafter, the manifold assembly 100 conveys the pressurized fluid mixture to the well head (not shown) via the high-pressure manifold output 36.

In one embodiment, the manifold assembly 100 may include a plurality of manifold modules 102 that interconnect in a modular fashion to form one or more segmented flow lines 104, 106. The illustrated embodiment includes one or more high pressure flow lines 104 and one or more segmented low pressure flow lines 106. The high pressure flow lines 104 convey pressurized fluid mixtures from the pumps 34 to the high pressure manifold output 36. The low pressure flow line 106 convey fluids from the low-pressure manifold input 32 to the pumps 34.

Figure 2:
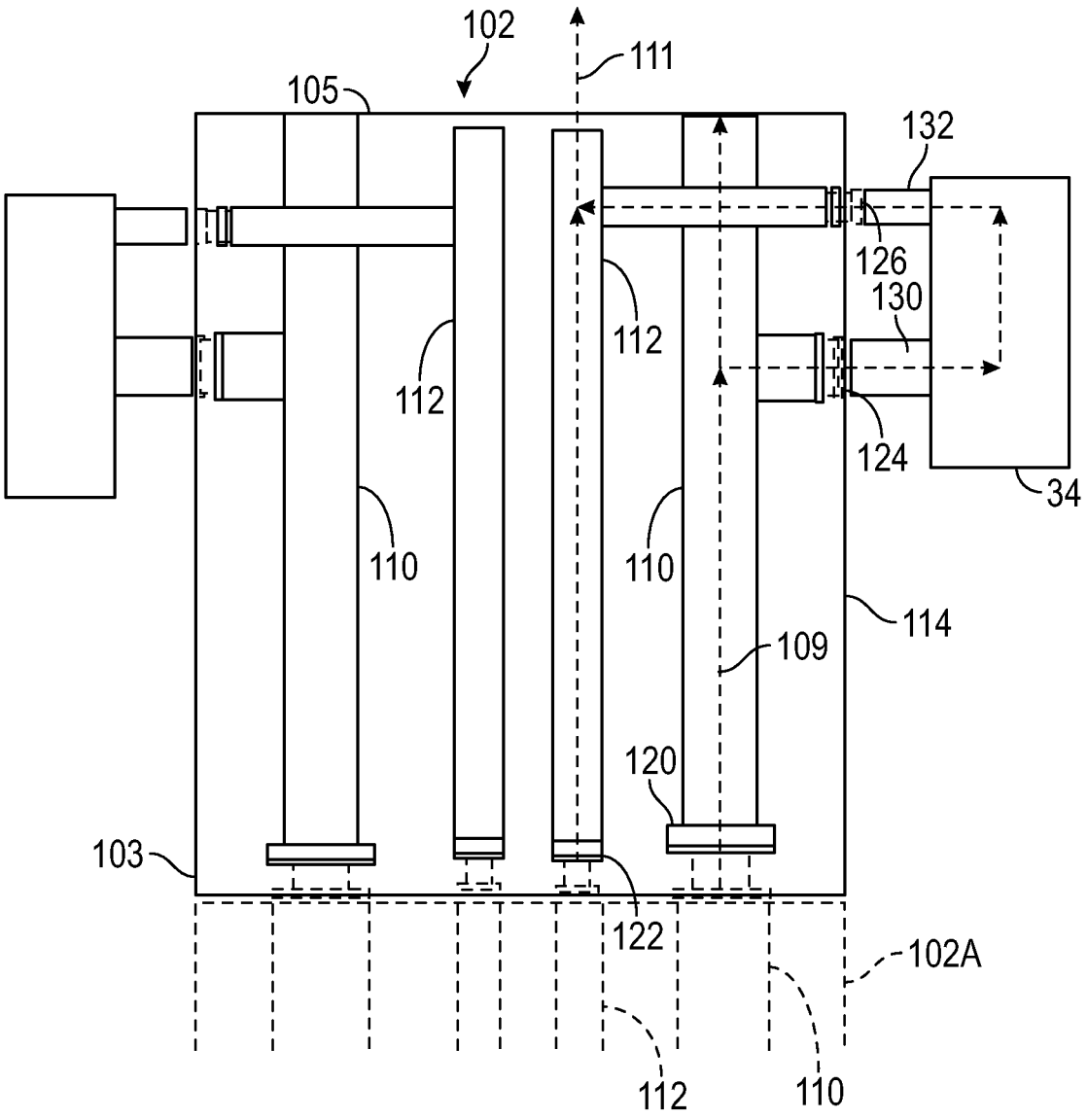
FIG. 2 illustrates an embodiment of a manifold module according to the present disclosure.

Referring to FIG. 2, there is shown one embodiment of a manifold module 102 according to the present disclosure. The manifold module 102 may include a plurality of low pressure flow line segments 110 and high flow line segments 112, all of which are supported on a skid 114. The low pressure flow line segments 110 may form a part of the low pressure flow line 106 (FIG. 1) and the high pressure flow line segments 112 may form a part of the high pressure flow line 104 (FIG. 1). The flow line segments 110, 112 may be formed of pipes or other tubular suitable for conveying fracturing fluid.

In embodiments, one or more of the flow line segments 110, 112 may include a connector for making a fluid tight connection to an adjacent connector assembly. The terms "fluid tight," "leak tight," and "pressure tight" may be used interchangeably to describe a connection that does not permit flowing material(s) (e.g., liquids, gases, entrained solids, and mixtures thereof) to escape while under prescribed operating conditions (e.g., flow rate, pressure, composition, etc.). The adjacent connector assembly may be associated with or a part of flow line segments 110, 112 of an adjacent manifold module 102A or the input/output lines of a pump 34. In one non-limiting arrangement, a first connector 120 may be used for a connection between a low pressure flow line segment 110 and a low pressure flow line segment 110 of an adjacent manifold module 102A; a second connector 122 may be used for a connection between a high pressure flow line segment 112 and a high pressure flow line segment 112 of the adjacent manifold module 102A; a third connector 124 may be used for a connection between a low pressure flow line segment 110 and a flow line 130 of an adjacent pump 34; and a fourth connector 126 may be used for a connection between a high pressure flow line segment 112 and a flow line 132 of the adjacent pump 34.

In embodiments, connectors 120, 122 connecting one flow line segment 110, 112 to the flow line segments 110, 112 of an adjacent manifold module 102A are positioned on an input side 103 of the manifold module 102 instead of an output side 105 of the manifold module 102. The output side 105 of the flow line segments 110, 112 are static and may include connectors (not shown) that are not extendable. In these embodiments, a flexible hose or another type of connector may be used to accommodate any misalignment or gaps between adjacent flow lines. During use, fluids flow into the input side 103 and flows out of the output side 105 via the flow line segments 110, 112. The flow of low pressure fluid mixture to the pumps 34 is shown with arrow 109. The flow of fluid mixture from the pumps 34 is shown with arrow 111. In other embodiments, the connectors 120, 122 may be positioned on the output side 105 of the flow line segments 110, 112. In still other embodiments, the connectors 120, 122 may be positioned on the output side 105 and the input side 103 of the flow line segments 110, 112.

The configuration of the connectors 120, 122, 124, 126 may be dictated by the type of adjacent connector and the fluid mixture parameters (e.g., weight, pressure, composition, fluid flow rates, etc.) in associated flow line segment 110, 112. A common feature of the connector 120, 122, 124, 126 is a end face that can be axially extended to close the gap separating that connector from the adjacent connector assembly. An extended position of the connectors 120, 122, 124, 126 are shown in hidden lines. While all the connectors 120, 122, 124, 126 are shown with axially extendable end faces, it should be understood that axially extendable end faces may be used on less than all of the connectors 120, 122, 124, 126, or just one of the connectors 120, 122, 124, 126.

Figure 3A:
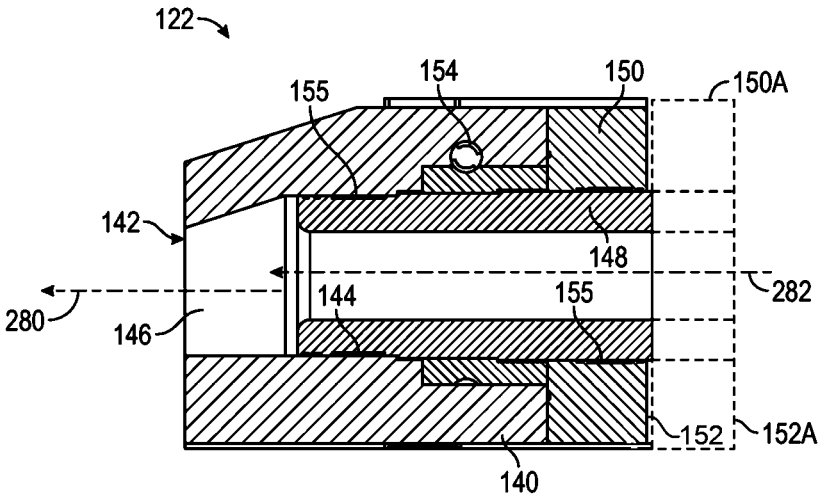
FIGS. 3A-C illustrate embodiments of a connector with an extendable end face according to the present disclosure.

Referring to FIG. 3A, there is shown one non-limiting embodiment of the second connector 122, which is used for a connection between a high pressure flow line segment 112 (FIG. 2) and a high pressure flow line segment 112 (FIG. 2) of the adjacent manifold module 102A (FIG. 2). The connector 122 may include a body 140 in which is formed a passage 142 having a bore section 144 and a fluid path 146. A telescoping tubular member 148 may be disposed in the bore section 144 and include a sealing plate 150 having a planar end face 152. When axially displaced by an actuator 154, the tubular member 148 slides out of the bore section 144 an adjustable distance. An extended position of the end plate 150 and end face 152 is shown in hidden lines and numerals 150A and 152A, respectively. Seals 155 surrounding the tubular member 148 maintain a fluid tight connection when the tubular member 148 is partially or completely extended. Thus, the end face 152 may be extended from the body 140 to close a gap separating the second connector 122 from the adjacent connector assembly.

The illustrated actuator 154 is a geared system that uses mechanical leverage. A manual crank may be used to rotate the gear elements and thereby axially displace the tubular member 148. In other embodiments, the actuator 154 may be a hydraulic actuator driven by pressurized hydraulic fluid, a pneumatic actuator driven by pressurized gas, or an electric actuator driven by an electrical motor.

Figure 3B:
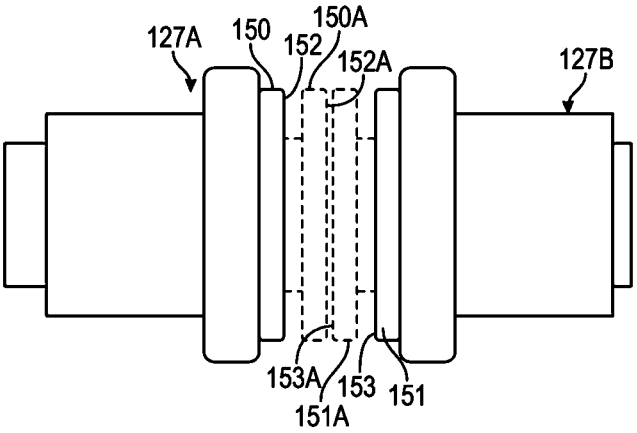

Referring to FIG. 3B, there is shown variants of connectors 127A,B in accordance with the present disclosure. The connectors 127A,B may be any of the connectors 120, 122, 124, 126 or other connectors discussed herein. Each connector 127A,B has an end plate 150, 151 and associated end faces 152, 153, respectively. The end plates 150, 151 are both extendable. The extended positions for the end plates 150, 151 are shown with hidden lines and numerals 150A and 151A. Thus, either or both of the end plates 150, 151 may be moved to close the gap separating the connectors 127A,B and form a leak proof connection at the contacting end faces 152A and 153A.

Figure 3C:
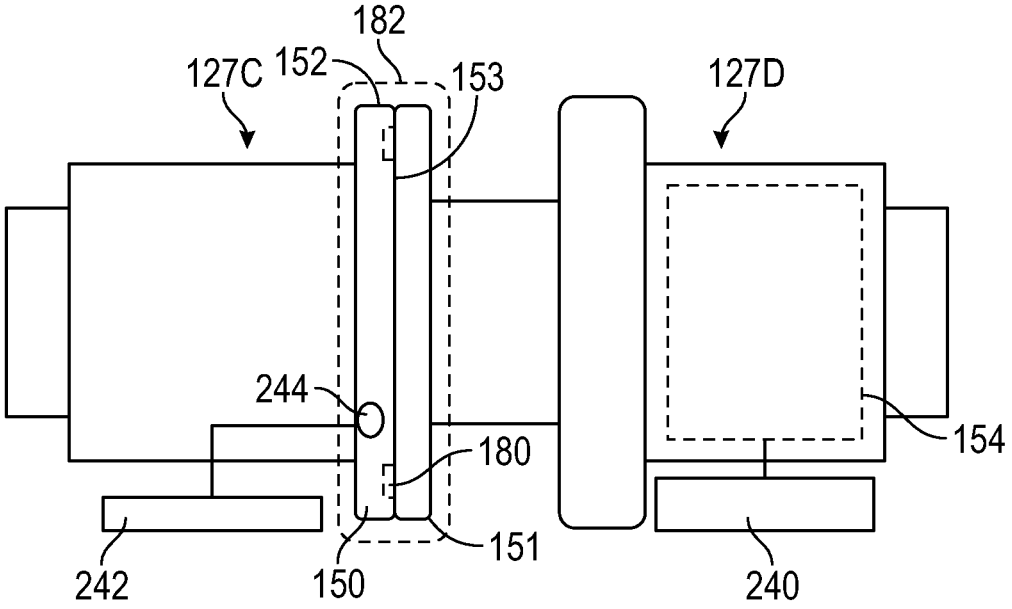

Referring to FIG. 3C, there are shown certain addition features with reference to connectors 127C,D, which may be any of the connectors 120, 122, 124, 126 or other connectors discussed herein. The end plate 151 is shown in an extended position and in sealing engagement with the end plate 150. In certain embodiments, one or more seals 180 may be disposed on one or both of the end faces 152, 153. The seal 180 may be formed of metals, non-metals, elastomers, composites, carbon fibers, resins, engineered materials, etc. Further, in certain embodiments, the connectors 127C,D use a flangeless clamping assembly 182. By "flangeless," it is meant that the clamping assembly 182 does not generate a compressive locking force by using bolts that penetrate through the end plates 150, 151. Instead, the clamping assembly 182 uses compression members, such as packing sealing, that do not directly contact the end plates 150, 151.

Figure 3D:
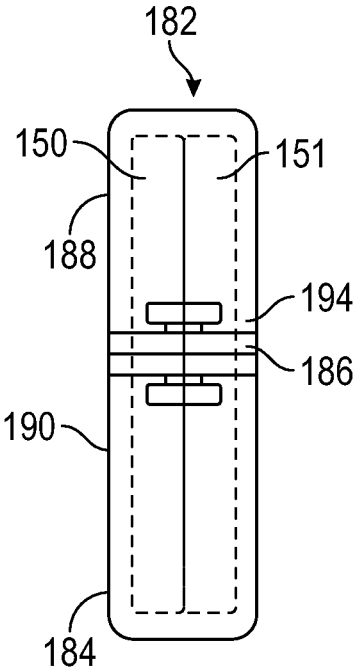
FIGS. 3D-E illustrate an embodiment of a clamping member according to the present disclosure.
Figure 3E:
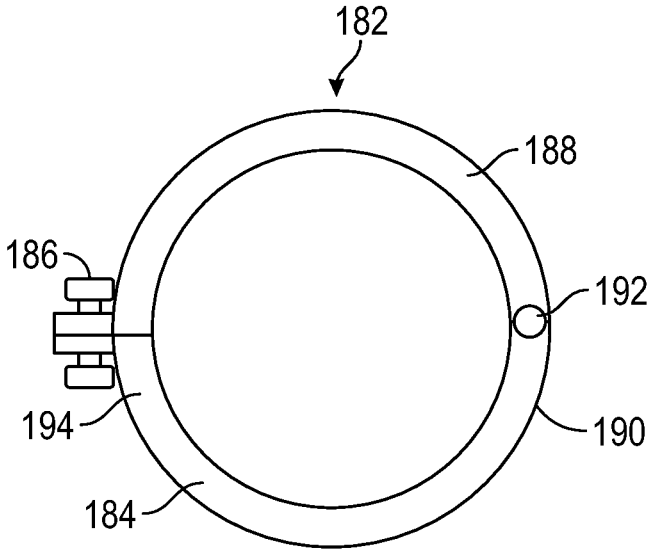

Referring to FIGS. 3D and 3E, there is shown one non-limiting embodiment of a flangeless clamping assembly 182. The clamping assembly 182 may include a body 184 and a locking member 186. The body 184 may have a first section 188 and a second section 190 that are connected at a hinge 192 and separate from one another at a non-hinged end 194. The body 184 may have a pocket or recess (not shown) in which at least an outer circumferential portion of the end plates 150 and 151 are seated. The locking member 186 may be a bolt or other fastening member that connects the sections 188, 190 together at the non-hinged end 194.

During use, the body 184 is opened by rotating the first section 188 and the second section 190 away from one another at the hinge 192. Next, the opened body 184 is fitted around the end plates 150, 151 and closed. The end plates 150, 151 may be partially or completely enclosed inside the body 184. Thereafter, the locking member 186 is turned, or otherwise manipulated, to apply a compressive force. This compressive force squeezes the first and second sections 188, 190 together and indirectly compresses the end plates 150, 151 against one another. While one locking member 186 is shown, two or more may be used. Nevertheless, it should be appreciated that the end plates 150, 151 have been secured to one another without installing and securing a number of individual bolts arrayed circumferentially around the end plates 150, 151.

Referring to FIG. 3C, in certain embodiments, the connection may be partially or completely automated. For example, in certain embodiments, a control unit 240 may be used to operate the actuator 154 that can translate, i.e., axially extend and retract, the end plate 151. Optionally, a data acquisition module 242 may be used to measure one or more parameters. For example, a relative position and/or orientation of the end plates 150, 151 may be detected using a suitable proximity sensor 244. The control unit 240 may include one or more microprocessors programmed with algorithms that can use manual and/or sensor inputs to control the movement of the end plate 151. For instance, the control unit 240 may process signals representative of measurements made by the sensor 244 and generate control signals to operate the actuator 154. Additionally, the control unit 240 may be programmed to control the clamping assembly 182, which may include suitable actuators (not shown). Thus, the connection and sealing engagement between two connectors can be partially or completely automated.

It should be understood that the FIG. 3 actuator 142 merely illustrates one arrangement for an extendable sealing plate 150 and end face 152. The remaining connectors 120, 124, and 126 may utilize an extendable sealing plate 150 and end face 152, but employ different configurations to extend the sealing plate 150 and end face 152. For example, the first connector 120 may have an extendable tubular 148 that is sufficiently light enough to be manually manipulated without need of an actuator. In other embodiments, the actuator may be positioned on the adjacent connector assembly.

It should further be understood that a connector with an extendable end face is not required for every fluid segment 110, 112 or even a majority of fluid segments 110, 112. For instance, connectors with an extendable end face may be used just within the high pressure flow line 112. Hoses or other flexible connectors may be used for other connections.

Figure 3F:
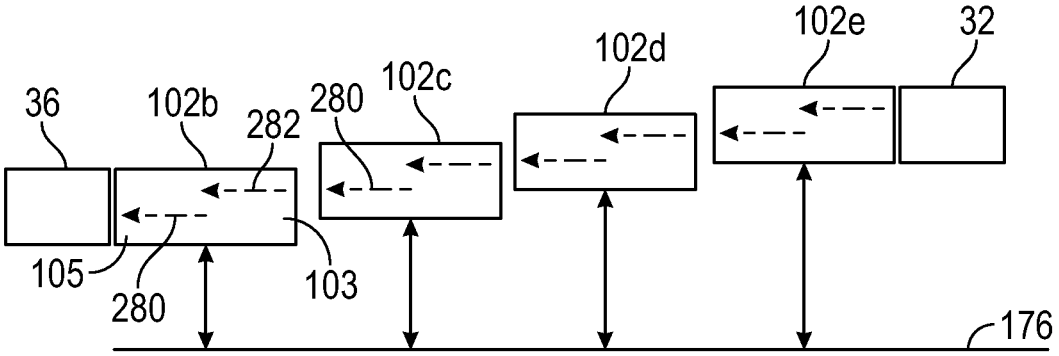
FIG. 3F illustrates manifold modules arranged to have a downward slope from an input to an output according to an embodiment of the present disclosure.

Referring now to FIGS. 3A and 3F, in embodiments, the connector 122 may be configured to slope or incline the flow lines 110, 112 (FIG. 2). In one arrangement, a slope may be enabled by using radially offset flow paths 280, 282. By radially offset, it is meant that the bores defining the flow paths 280, 282 are misaligned sufficiently to force at least some of the fluid traveling in the flow path 282 to direction in order to flow into and through the flow path 280. Fluid flows first into the flow path 282 from the input side 103 and then into the flow path 280, which leads to the output side 105. The radial offset is selected such that entry into the flow path 282 at the input side 103 is at a higher elevation than the exit of the flow path 280 at the output side 105. Referring to FIG. 3F, there is schematically shown four manifold modules 102*b-e*, each of which are positioned at different elevations above the ground 176. The manifold module 102*b* may be positioned immediately next to the high pressure manifold output 36 and the manifold module 102*e* may be positioned immediately next to the low pressure manifold input 32. The elevation of each of the modules 102*b-e* may be selected such that the flow path 280 of one manifold module aligns with the flow path 282 of an adjacent manifold module. Thus, fluid flows along a downward slope from the low pressure manifold input 32 to the high pressure manifold output 36.

Figure 4:
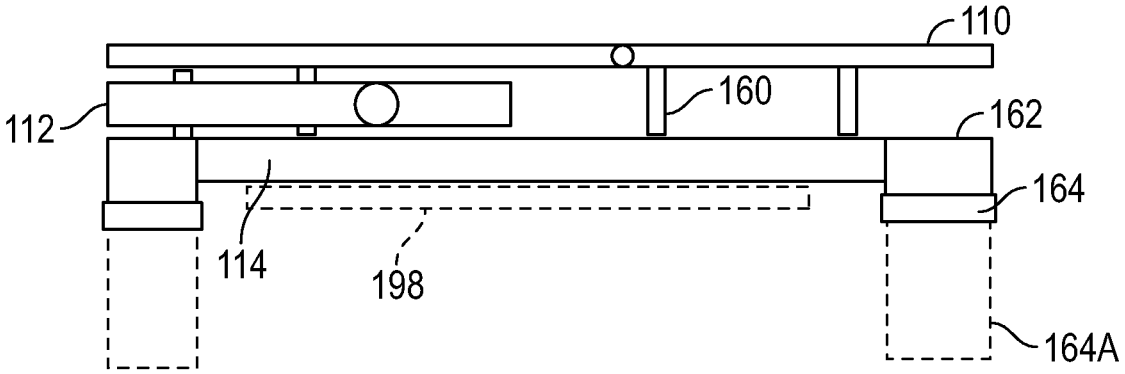
FIG. 4 schematically illustrates a side view of a manifold module according to one embodiment of the present disclosure.

Referring now to FIG. 4, in one embodiment, the skid 114 may include a frame assembly 160 for supporting the flow lines 110, 112 and a stand 162. The stand 162 is configured to suspend the skid 114 above the ground at a selected level. For example, the stand 162 may have legs 164 that can be extended to a desired length as shown with numeral 164A. The legs 164 may be actuated with an on-board actuator (not shown) or a separate actuator (not shown). The actuator (not shown) may be mechanical, hydraulic, pneumatic, or electric.

Figure 5A:
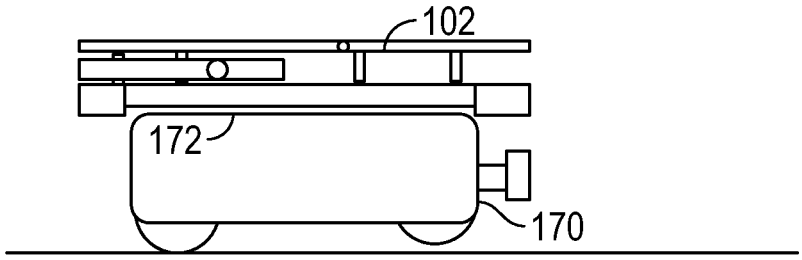
FIGS. 5A-D illustrate a method of positioning a manifold module according to one embodiment of the present disclosure.
Figure 5B:
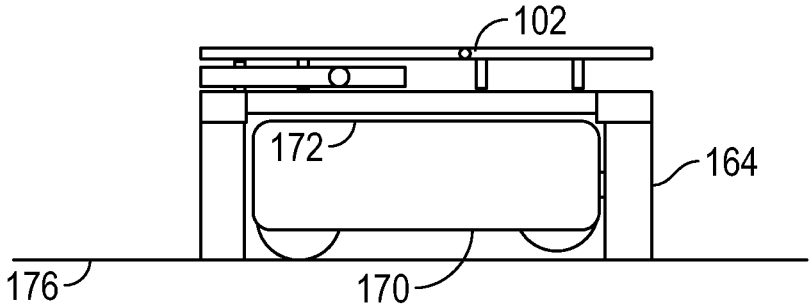
Figure 5C:
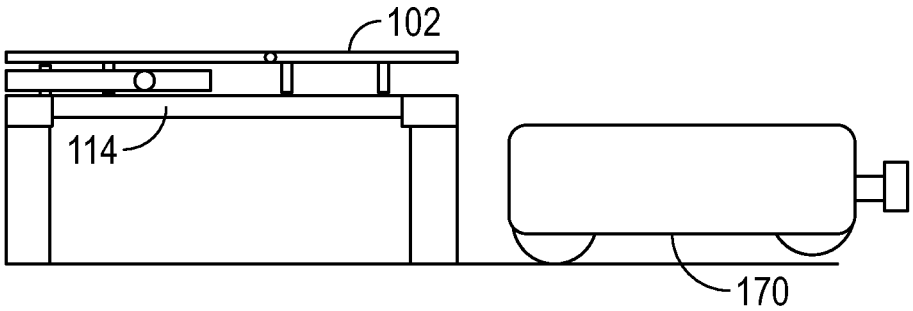
Figure 5D:
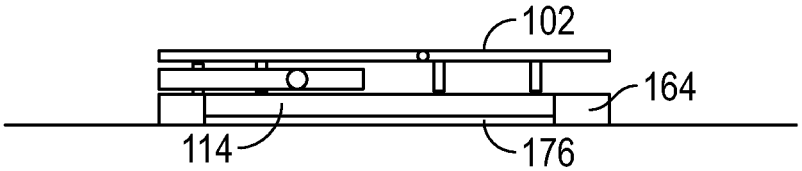

Referring now to FIGS. 1 and 5A-D, one method for assembling a manifold assembly 100 includes using a moveable platform 170 to convey the manifold modules 102 to a well site 10. The moveable platform 170 may be a cart, a trolley, trailer, or other platform that requires an external mover. The moveable platform 170 may also use a self-powered vehicle such as an automobile, a tractor, a semi, etc. As shown in FIG. 5A, the manifold module 102 seats on a bed 172 of the platform 170 during transportation. In FIG. 5B, the platform 170 positions the manifold module 102 at a target location. In embodiments, the target location is directly over the position that the manifold module 102 will rest during operation. Once so positioned, the legs 164 are extended from the skid 114 until the skid 114 is firmly supported by the ground 176. Further, the legs 164 are further extended so that the skid 114 is elevated above the bed 172 of the platform 170. As shown in FIG. 5C, the platform 170 may be moved out from underneath the manifold module 102. Next, as shown in FIG. 5D, the legs 172 are retracted to lower the skid 114 into contact with the ground 176.

Advantageously, the manifold module 102 does not need to be re-positioned for assembly of the manifold assembly 100. This is due, in part, to the extendable end face 152 (FIG. 3) being available to compensate for any minor misalignment between adjacent manifold modules 102.

Further, it should be appreciated that repair of individual manifold modules 102 is also facilitated. That is, if a manifold module 102 were to require some type of repair or maintenance, that manifold module 102 need only be decoupled from the adjacent manifold modules and pumps 34, lifted using the stand 162, and moved away using the platform 170. Thus, the amount of lifting and handling of surrounding equipment has been minimized or eliminated.

Figure 6A:
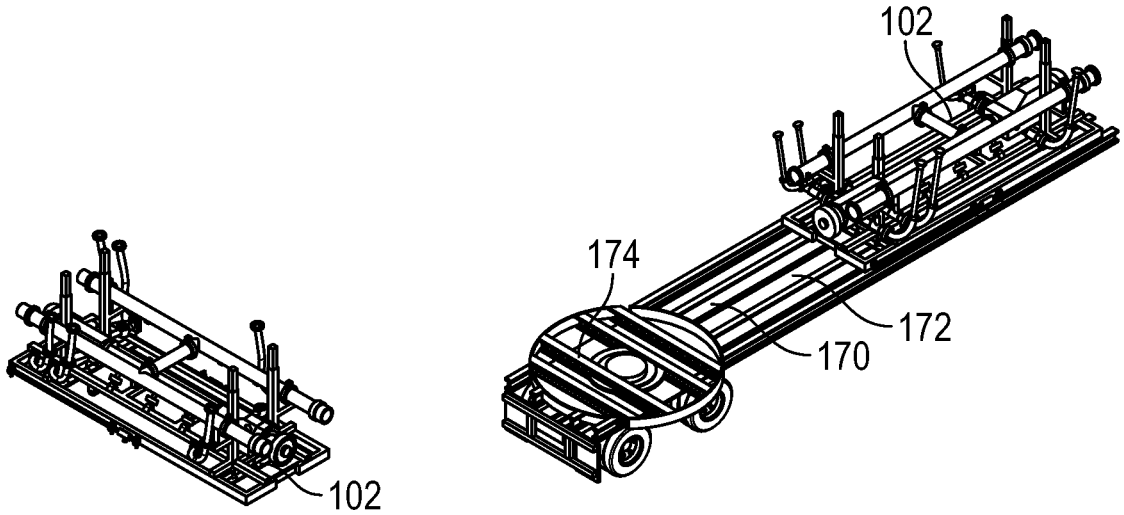
FIGS. 6A-F illustrate another method of positioning a manifold module according to one embodiment of the present disclosure.
Figure 6B:
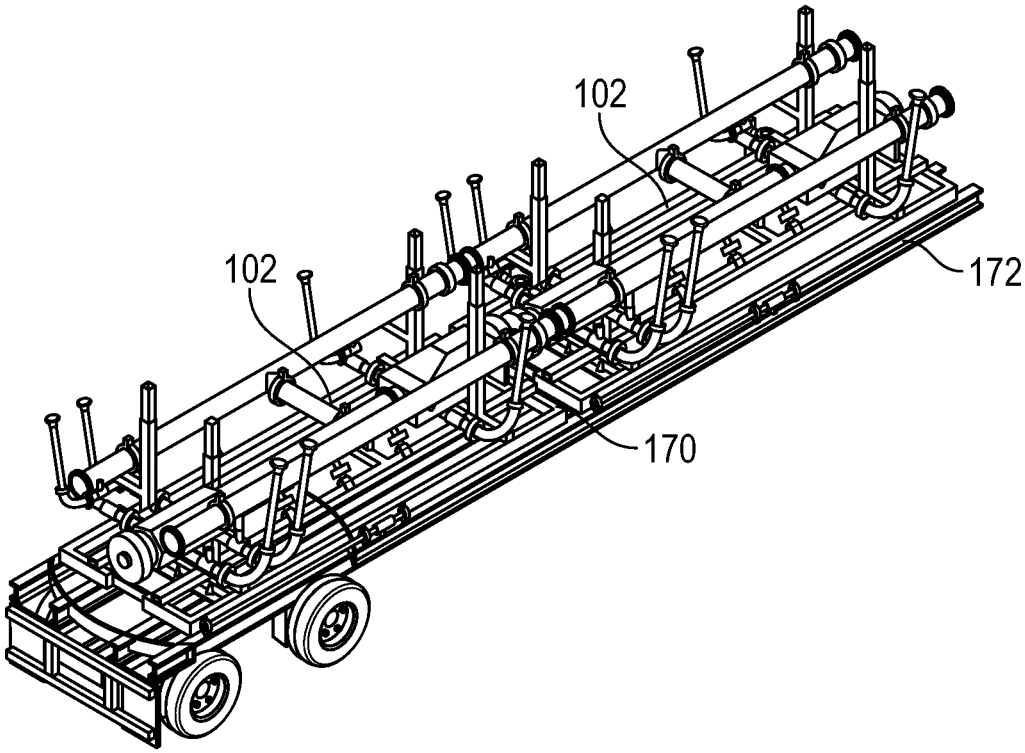

Referring now to FIGS. 1 and 6A-E, another method for assembling a manifold assembly 100 includes using the transport vehicle 170 to convey manifold modules 102 to a well site 10. As shown in FIG. 6A, the manifold module 102 seats on a bed 172 of the platform 170 during transportation. While two manifold modules 102 are shown, greater or fewer manifold modules 102 may be transported by a mobile platform 170. Further, the bed 172 has a table 174 that can rotate and translate. In FIG. 6B, the manifold modules 102 are shown rotationally oriented in a transport position, wherein the long side of each manifold module 102 is aligned with the long side of the bed 172.

Figure 6C:
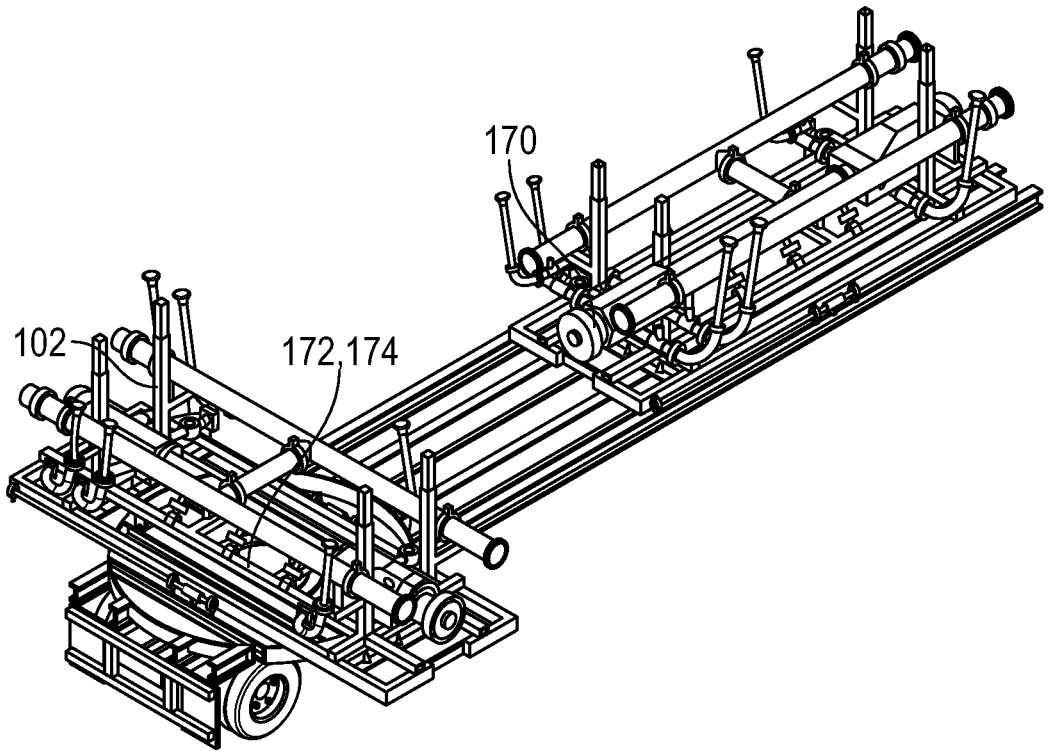

In FIG. 6C, the platform 170 uses the table 174 to position the manifold module 102 by rotating the manifold module 102 and axially sliding the manifold module 102 over the target location. The rotational orientation of the manifold module 102 may be ninety degrees offset from the transport position. However, other angular offsets may be used. In embodiments, the target location is directly over the position that the manifold module 102 will rest during operation.

Figure 6D:
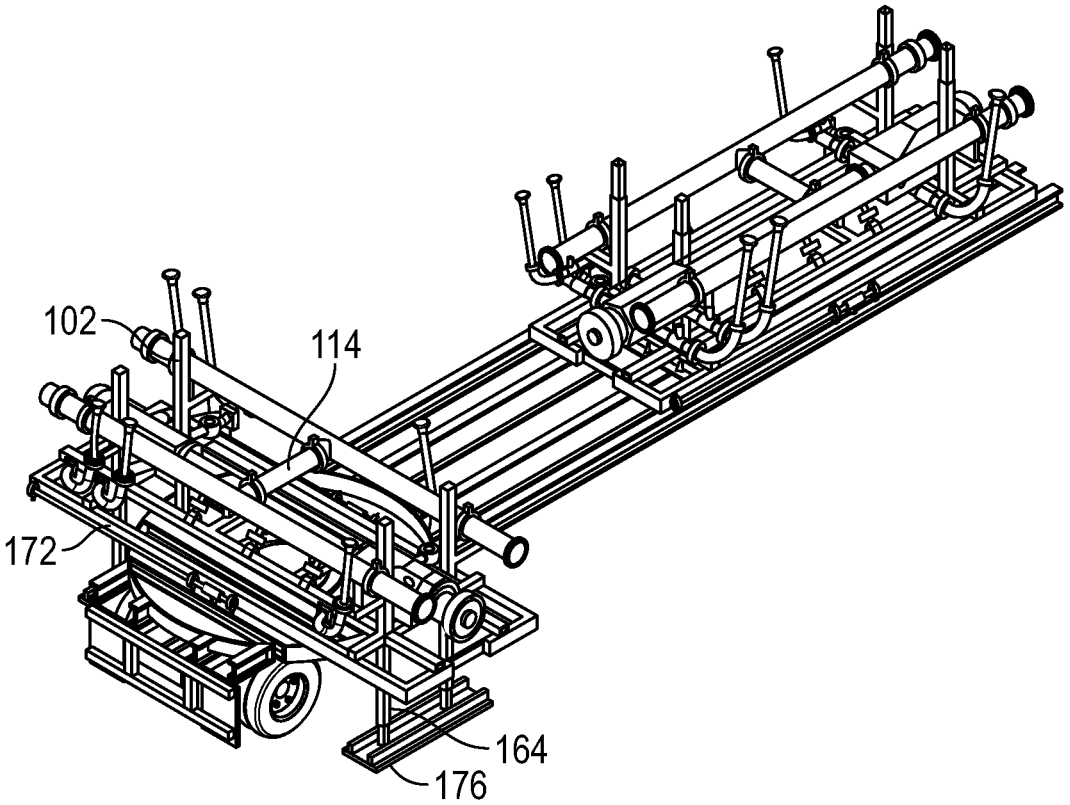

As shown in FIG. 6D, once so positioned, the legs 164 are extended from the skid 114 until the manifold assembly 102 is firmly supported by the ground 176 and elevated above the bed 172 of the platform 170.

Figure 6E:
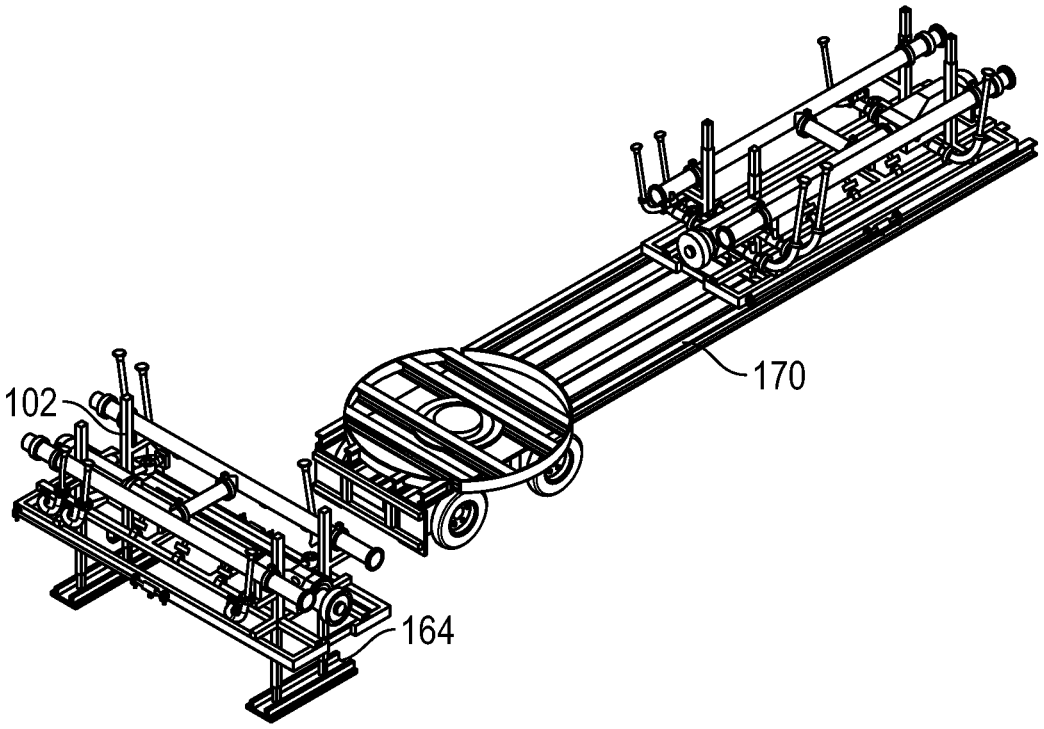
Figure 6F:
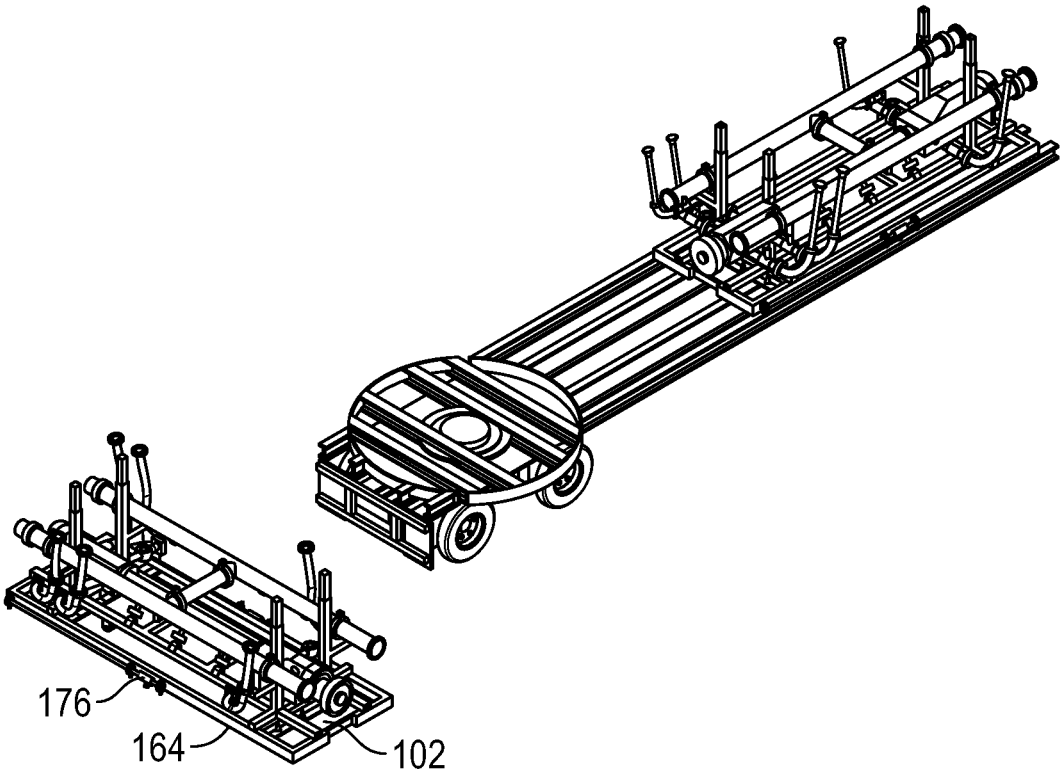

As shown in FIG. 6E, the platform 170 may be moved out from underneath the manifold module 102. Next, as shown in FIG. 6F, the legs 164 are retracted to lower the manifold module 102 into contact with the ground 176.

It should be appreciated that positioning the manifold module 102 at the final operating position did not require cranes or other external lifting and handling equipment.

Referring to FIG. 1, it should be understood that the deployment and position methods of FIGS. 5A-D and Figs. A-E may be used to position any component making up or associated with the system 20, such as the pump(s) 34 and the mixer(s) 30.

Referring to FIG. 1, after the manifold modules 102 have been positioned at their respective target locations at the well site 10, assembly of the system 20 may begin by connecting the manifold modules 102 to form the manifold assembly 100. The actual sequence of steps may vary depending on the well site 10. One illustrative sequence may begin with interconnecting the flow line segments 110, 112 associated with each of the manifold modules 102. When connectors 122 are used, the manifold modules 102 are oriented such that the connectors 122 are attached to the input end 103 of the flow line segment 112.

To form the high pressure flow line 104, the end face of the connector 122 for each flow line segment 112 may be extended into sealing engagement with an adjacent flow line segment 112. To form the low pressure flow line 106, the end face of the connector 120 for each flow line segment 110 may be extended into sealing engagement with an adjacent flow line segment 110. Additionally, to connect the pumps 34, the end faces of the connectors 124, 126 may be extended into sealing engagement with the connectors 130, 132, respectively, of each pump 34.

As noted previously, connectors with extendable end faces may be used on one, some, or all of the flow line segments 110, 112. Irrespective of the configuration used, it should be appreciated that connections with extendable end faces may be completed without moving the manifold modules 102 and without using additional fluid fittings, hoses, etc.

Figure 7:
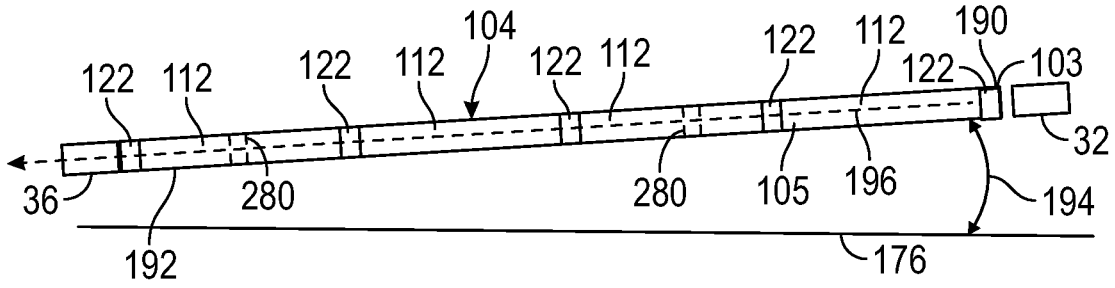
FIG. 7 schematically illustrates a side view of a flow line according to one embodiment of the present disclosure.

Referring to FIG. 7, there is shown a flow line formed by a set of flow line segments. For brevity, the flow line is referred to as the segmented high pressure flow line 104. However, some or all of the features discussed below may be also used in low pressure flow line 106 (FIG. 1). As shown, the high pressure flow line segments 112 are positioned end-to-end and are connected to one another by connectors 122. As discussed previously, the connectors 122 are positioned on the input side 103 of each high pressure flow line segment 112. A first end 190 of the high pressure flow line 104 is immediately adjacent to the low pressure manifold input 32. A second end 192 of the high pressure flow line 104 connects to the high pressure manifold output 36. Line 196 illustrates the direction of flow of the fluid mixture through the high pressure flow line 104.

It should be appreciated that the entire fluid conduit between the first end 190 and the second end 192 does not include flexible fluid conveyance devices such as hoses. Rather, the high pressure flow line 104 includes only rigid fluid conveyance members, such as pipes. As used herein, a "rigid" flow line is a flow line that does not use flexible hoses or other similar flexible umbilicals to convey fluid between flow line segments. In some arrangement, a "rigid" flow line is one that only uses metal pipe and connectors to convey fluids and fluid mixtures. In some arrangements, a "rigid" flow line is one that conveys fluids and fluid mixtures using pipes or other tubulars that have a modulus of elasticity of at least $5\times10^6$ PSI. In some arrangements, a "rigid" flow line is one that conveys fluids and fluid mixtures using pipes or other tubulars. It should be noted that non-rigid members such as seals or washers may be used along the high pressure flow line 104. However, the connection between each adjacent high pressure flow line segments 112 is formed by the connector 122, which includes an extendable end face 152 (FIG. 3) as discussed previously.

It should further be noted that the high pressure flow line 104 is inclined relative to the ground 176. An angle 194 of the incline may be between one degree to about fifteen degrees and in some arrangements greater than fifteen degrees. The angle 194 is oriented such that the high pressure flow line 104 slopes downward from the first end 190 to the second end 192. Also, in certain embodiments, one or more flow restrictors 280 may be used to equalize pressure along the flow line 104. As described previously, pumps 34 (FIG. 1) injected the fluid mixture at multiple points along the flow line 104. By selectively restricting the cross-sectional flow area along the flow line 104, the pressure profile may be shaped to prevent locations of excessive pressure, which may impair overall flow rate and efficiency.

It should be understood that the teachings of the present disclosure are susceptible to numerous variants, some of which are discussed below.

As noted above in connection with FIG. 2, the adjacent connector assembly may be associated with or a part of flow line segments 110, 112 of an adjacent manifold module 102 or the input/output lines of a pump 34. Referring to FIG. 1, in some embodiments, the adjacent connector assembly may be the low pressure manifold input 32 and/or the high pressure manifold output 36.

As noted above in connection with FIG. 6A, a table 174 may be positioned on the bed 172 of the platform to rotate/axially slide a manifold module 102 between two angular positions, i.e., a transport position and an installation position. Referring to FIG. 4, in some embodiments, a table 198 may be disposed on a bottom portion of the skid 114. The table 198 may include an axle or similar device to permit rotation and rollers/rails to allow linear, or translational, movement.

Figure 8:
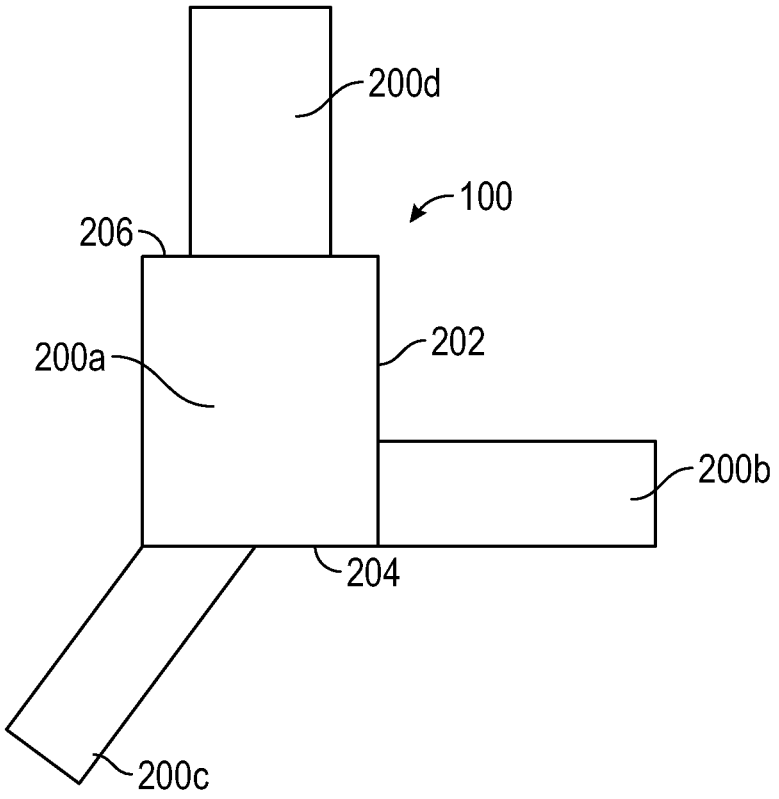
FIG. 8 illustrates variants of manifold modules according to the present disclosure.
Figure 9:
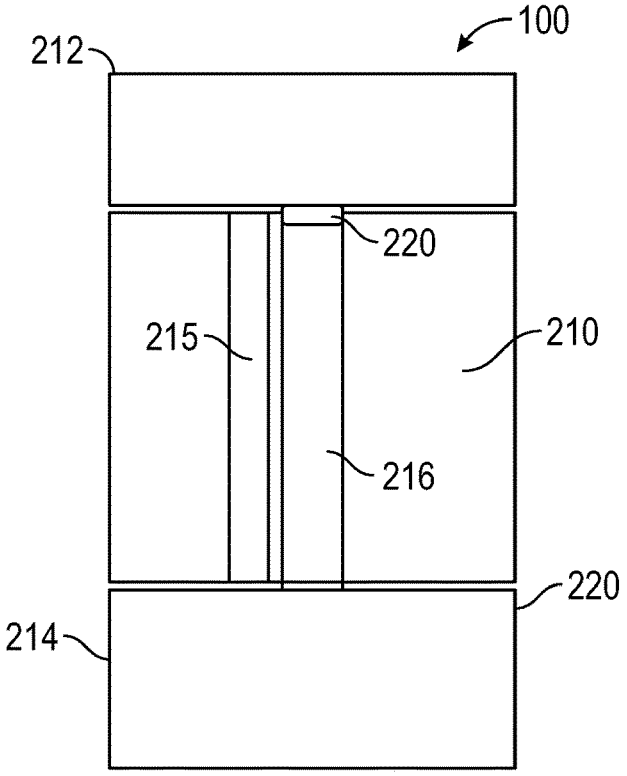
FIG. 9 illustrates a variant of a manifold assembly according to the present disclosure.

Referring now to FIGS. 8 and 9, there are shown variants of the manifold assembly 100. In FIG. 8, the manifold assembly 100 is formed of manifold modules 200*a-d* that may use different geometric shapes and angular connections. For example, the manifold module 200*a* connects at angled sides 202, 204 to manifold modules 200*b,c*. While the angle is shown as ninety degrees, the sides 202, 204 may be at acute or obtuse angles. Further, the manifold module 200*a* connects to a third manifold module 200*d* on the side 206. Thus, manifold module 200*a* also illustrates a variant wherein one input, e.g., via manifold module 200*d*, is divided into two outputs, e.g., manifold modules 200*b*, 200*c* or two inputs via manifold modules 200*b*, 200*c* are combined into one output, e.g., at manifold module 200*d*. Additionally, it should be noted that manifold module 200*c* is at a non-perpendicular angle relative to the side 204 of manifold module 200*a*. Thus, while certain embodiments may include manifold modules of identical shapes and dimensions, other embodiments may employ manifold modules of various sizes, shapes, and connection configurations.

FIG. 9 illustrates another embodiment of a manifold assembly 100 that is essentially composed of one manifold module 210 that connects to an input 212 and an output 214. The input 212 may be any structure or arrangement that conveys a fluid mixture to the manifold assembly 100. In one embodiment, the input 212 may be low pressure manifold as describe previously that conveys a fluid mixture from a mixer. In another embodiment, the input 212 may be an integrated mixer/pressure increaser wherein two or more components are mixed and ejected at sufficiently high pressure for the desired fracturing operation. In still another embodiment, the input 212 may supply or convey a fluid mixture from one or more pumps 34 (FIG. 1). In this arrangement, the manifold module 100 may have at least one low pressure flow line 215 and at least one high pressure flow line 216, each of which may have one or more connectors 220 with extendable end faces as described previously. In other arrangements, the manifold module 100 may have two or more flow lines, at least one of which has one or more connectors with extendable end faces as described previously. The output 214 may be the high pressure manifold output 36 (FIG. 1) in one embodiment. In other embodiments, the output 214 may be a different manifold structure, e.g., one that does not use manifold modules.

A variant of the FIGS. 5A-D and 6A-E methods for assembling a manifold assembly 100 may also be used to position the FIG. 9 manifold 100 at a well site 10 (FIG. 1). The method may include transporting the manifold module 100 using a platform 170 as described in FIGS. 5A-D and 6A-E to the well site 10 (FIG. 1) while supporting the manifold module 100 on a bed 172 of a vehicle, using the platform 170 to position the manifold module 100 directly over a target location, extending a stand 162 from the manifold module 100 toward the ground, lifting the manifold module 100 off the bed 172 using the extended stand 162, moving the platform 170 away from under the manifold module 100, and lowering the manifold module 100 using the stand 162. Referring to FIG. 1, after the FIG. 9 manifold module 100 has been positioned at the target location at the well site 10, assembly of the system 20 may begin by connecting the manifold assembly 100 to the input 212 and the output 214.

Figure 10:
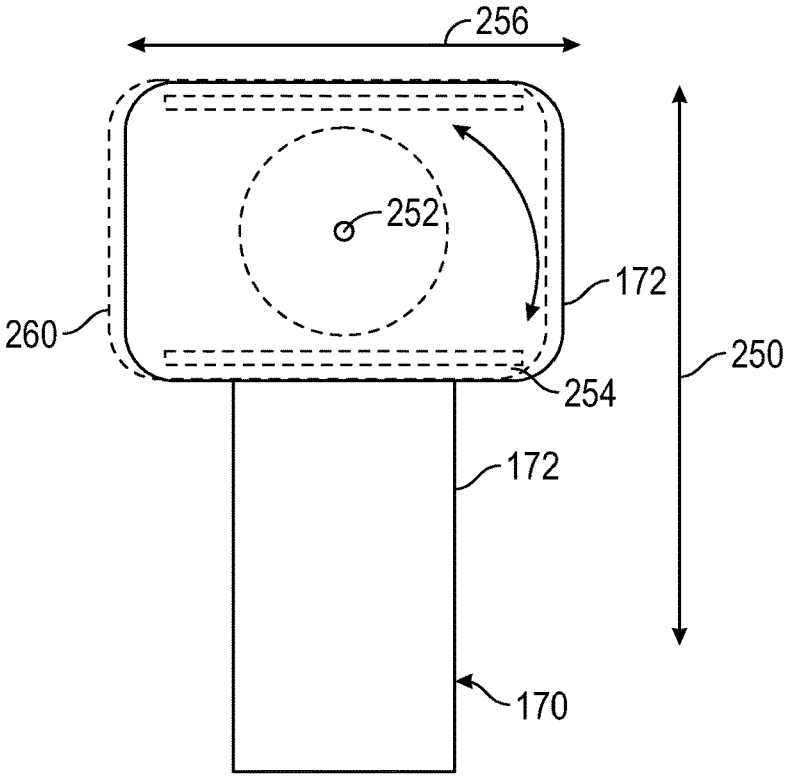
FIG. 10 illustrates an embodiment of manifold module with tracks according to one embodiment of the present disclosure.

FIG. 10 illustrates an embodiment of a manifold module 102 that can be manipulated with respect to three different axes. As discussed previously, the bed 172 of the platform 170 may be configured to translate the manifold module 102 along a long axis 250 and rotate the manifold module 102 about a vertical axis 252. Additionally, in some embodiments, one or more tracks 254 may be positioned on either the manifold 102 or the bed 172 to shift the manifold 102 along an axis 256 that is transverse to the long axis 250. A shifted position of the manifold module is shown with label 260. Further, as noted previously, the elevation of the manifold 102 may be adjusted using the stand 162 (FIG. 4). Thus, the manifold module 102 may be manipulated along a fourth axis and thereby have up to four degrees of freedom of movement. It should be noted that embodiments of the manifold module 102 may have less than four degrees of freedom of movement and that embodiments may have different combinations of axes along which the manifold module 102 may be manipulated (e.g., translation-rotation-elevation, rotation-elevation, lateral-elevation, etc.)

Thus, it should be appreciated that the manifold module 102 can be precisely positioned at a target location after being unloaded from the platform 170. That is, the position and orientation of the manifold module 102 can be precisely set prior to the manifold module 102 being lifted off the platform 170.

Figure 11:
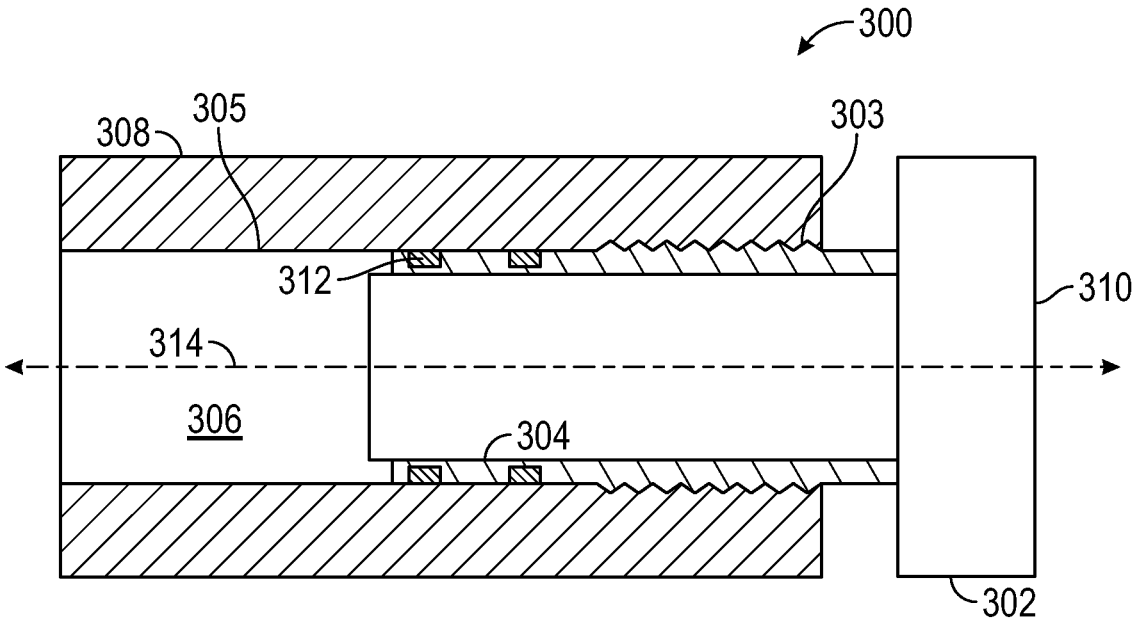
FIG. 11 illustrates an embodiment of a connector according to another embodiment of the present disclosure.

Referring to FIG. 11, there is shown another embodiment of a connector 300, which may be any of the connectors 120, 122, 124, 126 (FIG. 2). In this embodiment, a mechanical form of actuation is used to axially translate an end plate 302. In one arrangement, complementary threads 303 may be formed on a mandrel 304, which supports the end plate 302, and an inner surface 305 of a bore 306 in a body 308 of the connector 300. Rotation of the end plate 302 axially displaces the end plate 302 and an associated contact face 310. Seals 312 disposed around the mandrel 304 provide a leak proof barrier between the mandrel 304 and the body 308. It should be noted that the connector 300 has a continuous flow path 314 as opposed to vertically stepped flow paths as in the FIG. 3A embodiment. If desired, a slope as shown in FIG. 7 may be obtained by varying the elevation of each manifold module as previously described.

Figure 12:
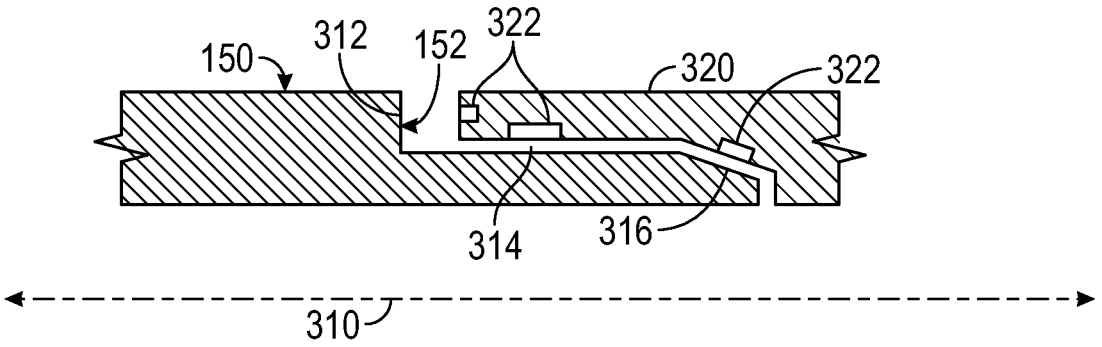
FIG. 12 illustrates an embodiment of an end plate of a connector according to another embodiment of the present disclosure.

Referring to FIG. 12, there is shown another embodiment of an end plate 150 that has a sealing face 152. In this embodiment, the sealing face 152 has multiple surfaces, each of which has a different angle relative to a longitudinal axis 310 along which the end plate 150 translates, which may be parallel with the flow of fluid. For example, the sealing surface 152 may have a first surface 312 that is transverse to the axis 310, a second surface 314 that is parallel to the axis 310, and a third surface 316 that is inclined relative to the axis 310. An adjacent connector assembly 320 may have surfaces complementary to the surfaces 312, 314, and 316. Additionally, suitable sealing members 322 may be positioned on one or more of the surfaces 312, 314, and 316 to provide a leak proof barrier between the end plate 150 and the adjacent connector assembly 320. For example, compression activated packing elements may be used. It should be appreciated that the end plate 150 may be tubular as shown, as disk-like as illustrated previously, or any other suitable shape. Further, the end face 152 may have one or more sealing surfaces and the surfaces may have any desired orientation relative to the axis 310.

While the foregoing disclosure is directed to the one mode embodiments of the disclosure, various modifications will be apparent to those skilled in the art. It is intended that all variations be embraced by the foregoing disclosure.

We claim:

1. A system for delivering a fracturing fluid at a well site, the system comprising:

an input; and a manifold assembly connected to and positioned to receive a fluid mixture from the input, the manifold assembly including a plurality of manifold modules, one or more of the manifold modules including:

a plurality of flow line segments, and at least one connector having an extendable tubular member, an end face, and at least one seal disposed on an end of the extendable tubular member, the at least one connector connecting at least one flow line segment of the plurality of flow line segments to an adjacent connector assembly, the at least one seal maintaining a fluid tight connection when the extendable tubular member is one of partially extended or completely extended, the at least one connector comprising:

a connector body; and gear elements connected to the connector body and the extendable tubular member, at least one of the gear elements being positioned to be rotated and cause the extendable tubular member to extend from the connector body toward the adjacent connector assembly.

2. The system of claim 1, wherein the extendable tubular member of the at least one connector is movable relative to the at least one flow line segment.

3. The system of claim 2, further comprising an actuator configured to move the extendable tubular member between at least a first position and a second position.

4. The system of claim 3, wherein the actuator is one or more of: (i) a mechanical actuator, (ii) a hydraulic actuator, (iii) a pneumatic actuator, or (iv) an electric actuator.

5. The system of claim 3, further comprising a control unit configured to operate the actuator.

6. The system of claim 1, further comprising:

at least one high pressure flow line that includes a first set of flow line segments; and at least one low pressure flow line that includes a second set of flow line segments, the at least one high pressure flow line being configured to convey fluid at a higher pressure than a fluid flowing in the at least one low pressure flow line.

7. The system of claim 6, wherein the at least one connector includes a plurality of connectors interconnecting the first set of flow line segments in the at least one high pressure flow line.

8. The system of claim 6, wherein the at least one connector includes a plurality of connectors interconnecting the second set of flow line segments in the at least one low pressure flow line.

9. The system of claim 6, wherein the at least one connector includes a plurality of high pressure connectors and a plurality of low pressure connectors, wherein the plurality of high pressure connectors interconnect the first set of flow line segments in the at least one high pressure flow line, wherein the plurality of low pressure connectors interconnect the second set of flow line segments in the at least one low pressure flow line, and wherein the high pressure connectors and the low pressure connectors use different actuator configurations.

10. The system of claim 1, wherein the adjacent connector assembly is associated with a flow line segment of an adjacent manifold module.

11. The system of claim 1, further comprising a flow line formed by a set of flow line segments, wherein the flow line has a first end and an opposing second end, and wherein the flow line is rigid between the first end and the second end.

12. The system of claim 1, wherein the adjacent connector assembly is associated with one or more of: (i) at least one pressure increaser, (ii) a low pressure manifold, (iii) a high pressure manifold, or (iv) an integrated mixer/pressure increaser.

13. The system of claim 1, further comprising a clamping assembly having a body in which a recess is formed, the recess being configured to receive the end face of the at least one connector.

14. The system of claim 13, wherein the clamping assembly is flangeless.

15. The system of claim 1, wherein at least one manifold module includes a track, the at least one manifold module being shiftable along a selected axis using the track.

16. The system of claim 11, wherein the flow line is configured to have a downward slope relative to the ground between the first end and the second end.

17. A system for delivering a fracturing fluid at a well site, the system comprising:

a manifold assembly positioned to receive a fluid mixture from an input, the manifold assembly comprising a plurality of manifold modules, one or more of the manifold modules comprising:

one or more flow line segments; and at least one connector connected to a first flow line segment of the one or more flow line segments and positioned to connect the first flow line segment to a second flow line segment of an adjacent manifold module, the at least one connector comprising:

a connector body including a passage providing a fluid path;

an extendable tubular member connected to the connector body and positioned to extend from the connector body to at least partially close a gap between the first flow line segment and the second flow line segment; and gear elements connected to the connector body and the extendable tubular member, at least one of the gear elements being positioned to be rotated and cause the extendable tubular member to extend from the connector body toward the second flow line segment.

18. The system of claim 17, wherein the at least one connector further comprises a sealing plate connected to the extendable tubular member, the sealing plate including a substantially planar end face configured to engage and provide a substantially fluid-tight seal with the second flow line segment.

19. A system for delivering a fracturing fluid at a well site, the system comprising:

a manifold assembly positioned to receive a fluid mixture from an input, the manifold assembly including a plurality of manifold modules, one or more of the manifold modules comprising:

one or more flow line segments;

a first connector connected to a first flow line segment of the one or more flow line segments and positioned to connect the first flow line segment to a second flow line segment of an adjacent manifold module, the first connector comprising:

a connector body including a passage providing a fluid path;

an extendable tubular member connected to the connector body and positioned to extend from the connector body to at least partially close a gap between the first flow line segment and a second connector connected to the second flow line segment; and gear elements connected to the connector body and the extendable tubular member, at least one of the gear elements being positioned to be rotated and cause the extendable tubular member to extend from the connector body toward the second flow line segment; and a clamp assembly to compress the first connector and the second connector together, the clamp assembly comprising:

a first section;

a second section connected to the first section; and a locking member positioned to connect the first section and the second section together around a first portion of the first connector and a second portion of the second connector.

20. The system of claim 19, wherein:

the first connector further comprises a sealing plate connected to the extendable tubular member, the sealing plate being configured to engage and provide a substantially fluid-tight seal with the second connector; and the first section and the second section of the clamp assembly are positioned to extend around the sealing plate and the second portion of the second connector.

* * * * *